US011958513B2

(12) United States Patent
Yamaguchi et al.

(10) Patent No.: US 11,958,513 B2
(45) Date of Patent: Apr. 16, 2024

(54) RAILROAD CAR CONDITION MONITORING/ANALYZING DEVICE AND METHOD

(71) Applicant: HITACHI, LTD., Tokyo (JP)

(72) Inventors: Takashi Yamaguchi, Tokyo (JP); Ryo Furutani, Tokyo (JP); Kenta Konishi, Tokyo (JP)

(73) Assignee: HITACHI, LTD., Tokyo (JP)

( * ) Notice: Subject to any disclaimer, the term of this patent is extended or adjusted under 35 U.S.C. 154(b) by 570 days.

(21) Appl. No.: 17/276,833

(22) PCT Filed: Dec. 13, 2019

(86) PCT No.: PCT/JP2019/048941
§ 371 (c)(1),
(2) Date: Mar. 17, 2021

(87) PCT Pub. No.: WO2021/117221
PCT Pub. Date: Jun. 17, 2021

(65) Prior Publication Data

US 2022/0063688 A1 Mar. 3, 2022

(51) Int. Cl.
*B61L 15/00* (2006.01)

(52) U.S. Cl.
CPC ..... *B61L 15/0081* (2013.01); *B61L 15/0054* (2013.01); *B61L 15/0072* (2013.01)

(58) Field of Classification Search
CPC ..... B61L 15/0072; B61L 15/0054; B61L 15/0081
(Continued)

(56) References Cited

U.S. PATENT DOCUMENTS 10,351,150 B1 * 7/2019 Lederman ..... B61L 23/042
2013/0342362 A1 * 12/2013 Martin ..... B61L 15/0018 374/152
(Continued)

FOREIGN PATENT DOCUMENTS

JP 3779258 B2 5/2006
JP 2008-108250 A 5/2008
(Continued)

OTHER PUBLICATIONS

International Search Report and Written Opinion of PCT/JP2019/048941 dated Mar. 3, 2020.
(Continued)

*Primary Examiner* — Ricky Go
(74) *Attorney, Agent, or Firm* — MATTINGLY & MALUR, PC

(57) ABSTRACT

A railroad car condition monitoring/analyzing includes: a car factor estimation unit configured to estimate car factor evaluation data from car data and evaluation data; an infrastructure factor extraction unit configured to extract infrastructure factor evaluation data from the car data, the evaluation data, and the car factor evaluation data; an infrastructure factor estimation unit configured to estimate individual infrastructure factor evaluation data from the infrastructure factor evaluation data; an infrastructure factor DB construction unit configured to store the individual infrastructure factor evaluation data in an infrastructure factor database; an infrastructure factor analysis unit configured to monitor the individual infrastructure factor evaluation data stored in the infrastructure factor database so as to analyze infrastructure factors; and a car analysis unit configured to analyze a car condition in consideration of analysis information on the infrastructure factor.

11 Claims, 8 Drawing Sheets

(58) Field of Classification Search
USPC ..... 702/33
See application file for complete search history.

(56) References Cited

U.S. PATENT DOCUMENTS

| | | | | |
|---|---|---|---|---|
| 2016/0272228 | A1* | 9/2016 | LeFebvre | H04L 67/12 |
| 2018/0339720 | A1* | 11/2018 | Singh | G06T 7/001 |

FOREIGN PATENT DOCUMENTS

| | | | |
|---|---|---|---|
| JP | 2011-245917 | A | 12/2011 |
| TW | M435471 | U1 | 8/2012 |

OTHER PUBLICATIONS

Taiwanese Office Action received in corresponding Taiwanese Application No. 109143576 dated Jul. 12, 2021.
Indian Office Action received in corresponding Indian Application No. 202117011938 dated Aug. 30, 2022.

* cited by examiner

RAILROAD CAR CONDITION MONITORING/ANALYZING DEVICE AND METHOD

BACKGROUND OF THE INVENTION

1. Field of the Invention

The present invention relates to a railroad car condition monitoring/analyzing device and method.

2. Description of the Related Art

As a railroad car condition monitoring device and condition monitoring method, for example, there is prior art described in JP-A-2011-245917 (Patent Literature 1).

That is, by comparing an amplitude ratio of accelerations measured by accelerometers respectively mounted on an axle box and a car body of a car with a threshold value, it is possible to separate factors of car-side abnormality and track-side abnormality and improve an accuracy of abnormality detection. Further, the threshold value of the amplitude ratio is registered in advance in a database in which traveling data in advance is organized based on a traveling position and a traveling speed of the car, and by using the threshold value recorded in the database, it is possible to improve the accuracy of condition monitoring and abnormality detection.

SUMMARY OF THE INVENTION

In the method described in Patent Literature 1 (JP-A-2011-245917), an abnormal phenomenon is separated into a car factor and a track factor from the data measured by sensors (accelerometers) mounted on the car so as to be evaluated. However, an abnormal phenomenon is affected not only by the car and the track but also by infrastructure around the track, and it is necessary to consider and evaluate infrastructure factors as well in order to improve the accuracy of abnormality analysis.

Further, in the method described in Patent Literature 1, by using a database in which past measurement data is organized, evaluation is performed in consideration of an influence of a traveling section. However, since the track factor (infrastructure factors) changes everyday, it takes time to investigate all the latest track conditions (infrastructure conditions) and update the database.

Furthermore, although it is conceivable to install a sensor that directly monitors the track condition (infrastructure condition) and analyze the abnormal phenomenon in consideration of data measured by the sensor, high cost is required for installing sensors that monitor the track condition (infrastructure condition) along the entire track.

Therefore, the invention aims to provide a technique for estimating infrastructure factors in addition to a car factor and analyzing and diagnosing an abnormal factor based on data measured by a sensor mounted on a car.

In order to solve the above-mentioned problem, one representative railroad car condition monitoring/analyzing device of the invention is configured to be connected to a data detection device that measures car data and evaluation data with a sensor mounted on a car, and an input device and an output device that input and output data, and includes: a car factor estimation unit configured to estimate car factor evaluation data from the car data and the evaluation data; an infrastructure factor extraction unit configured to extract infrastructure factor evaluation data from the car data, the evaluation data, and the car factor evaluation data; an infrastructure factor estimation unit configured to estimate individual infrastructure factor evaluation data from the infrastructure factor evaluation data; an infrastructure factor DB construction unit configured to store the individual infrastructure factor evaluation data in an infrastructure factor database; an infrastructure factor analysis unit configured to monitor the individual infrastructure factor evaluation data stored in the infrastructure factor database so as to analyze infrastructure factors; and a car analysis unit configured to analyze a car condition in consideration of analysis information on the infrastructure factors.

According to the invention, it is possible to monitor and analyze a condition of a rail road car in consideration of infrastructure factors by monitoring and analyzing an infrastructure condition with a sensor mounted on the railroad car without directly arranging a sensor on the infrastructure factors.

Problems, configurations and effects other than those described above will be clarified by the description of the following embodiment.

DESCRIPTION OF THE PREFERRED EMBODIMENTS

Hereinafter, an embodiment of the railroad car condition monitoring/analyzing device of the invention will be described with reference to the drawings.

First Embodiment

The configuration of the railroad car condition monitoring/analyzing device will be described with reference to FIG. 1.

Figure 1:
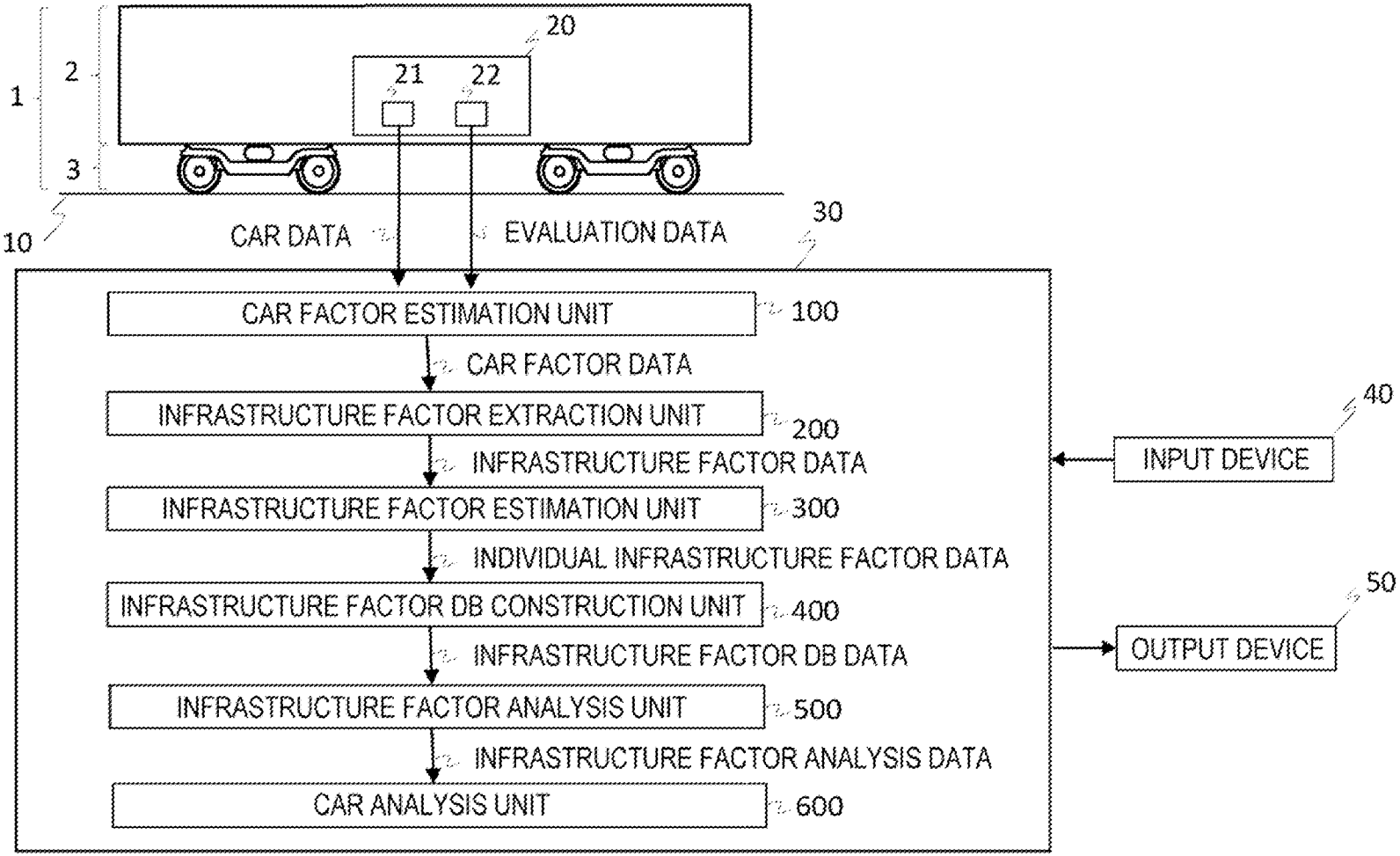
FIG. 1 is a diagram showing a configuration of a railroad car condition monitoring/analyzing device of the first embodiment of the invention.

In FIG. 1, a railroad car 1 includes a car body 2 and a bogie 3, and travels on a track (rail) 10. The car body 2 is equipped with a data detection device 20 including a car data detection unit 21 that measures a car condition and an evaluation data detection unit 22 that measures evaluation data. A condition monitoring/analyzing device 30 monitors and analyzes the car condition based on the data acquired by the data detection device 20 in consideration of infrastructure factors. An input device 40 and an output device 50 input and output data to/from the condition monitoring/analyzing device 30.

The data measured by the car data detection unit 21 includes, for example, a position, a speed, an acceleration, and a weight of the car, a time, an operating state of car components and mounted instruments, and the like, which are represented by N variables $\{X_i: i=1, 2, \ldots, N\}$ in the present embodiment. Further, the data measured by the evaluation data detection unit 22 is data representing the comfort and safety of the car and occupants, such as noise and vibration, which are represented by $M_1$ variables $\{Y_j: j=1, 2, \ldots, M_1\}$ in the present embodiment.

The data detection device 20 in FIG. 1 shows an example of a device for one car, but may also be a device for measuring the car data and the evaluation data for cars in formation (a plurality of cars).

A car factor estimation unit 100 of the condition monitoring/analyzing device 30 estimates car factor evaluation data based on the car data and evaluation data measured by the data detection device 20.

In the present embodiment, the car factor evaluation data is defined by M1 variables $\{Y_{Cj}: j=1, 2, \ldots, M_1\}$, and can be expressed by a function ($F_C$) of the following equation using the car data $\{X_i\}$ and the evaluation data $\{Y_j\}$.

$$Y_{Cj}=F_C(X_i, Y_j)$$

The function ($F_C$) can be obtained by, for example, multivariate analysis of the car data $\{X_i\}$ and the evaluation data $\{Y_j\}$, learning by deep learning, and the like.

An infrastructure factor extraction unit 200 of the condition monitoring/analyzing device 30 extracts infrastructure factor evaluation data based on the data ($X_i$, $Y_j$) measured by the data detection device 20 and the car factor evaluation data $\{Y_{Cj}\}$ generated by the car factor estimation unit 100.

In the present embodiment, the infrastructure factor evaluation data is defined by $M_1$ variables $\{Y_{Ij}: j=1, 2, \ldots, M_1\}$, and can be expressed by a function ($F_I$) for a difference between the evaluation data $\{Y_j\}$ and the car factor evaluation data $\{Y_{Cj}\}$.

$$Y_{Ij}(p,t)=F_I(Y_j-Y_{Cj})$$

Here, p and t are elements of the car data $\{X_i\}$ and represent a position of an infrastructure factor and the time. The position (p) is data indicating a location of the infrastructure factor along the track, and includes, for example, GPS position data, a traveling distance from a reference position (station), and the like.

An infrastructure factor estimation unit 300 of the condition monitoring/analyzing device 30 acquires individual infrastructure factor evaluation data from the infrastructure factor evaluation data extracted by the infrastructure factor extraction unit 200.

In the present embodiment, the individual infrastructure factor evaluation data is defined by L variables $\{Y_{Ijk}: k=1, 2, \ldots, L\}$, and can be expressed by the following equation using the infrastructure factor evaluation data ($Y_{Ij}$(p, t)).

$$Y_{Ijk}(p,t)=Y_{Ij}(p,t)$$

$$p\in[p_{kMin}, p_{kMax}]$$

$$t\in[t_{kMin}, t_{kMax}]$$

Here, $[p_{kMin}, p_{kMax}]$ and $[t_{kMin}, t_{kMax}]$ are a position range and a time range where individual infrastructure factors exist.

The range where the individual infrastructure factors exist is a section in which the infrastructure factor evaluation data ($Y_{Ij}$(p, t)) is equal to or greater than a threshold value ($Y_{IjLim}$). Therefore, by converting a range less than the threshold value ($Y_{IjLim}$) to zero for the infrastructure factor evaluation data ($Y_{Ij}$(p, t)) and dividing the infrastructure factor evaluation data obtained after the conversion with zero sections, the individual infrastructure factor evaluation data can be acquired.

Further, from the extracted individual infrastructure factors, feature quantities such as a representative position ($p_k=(p_{kMin}+p_{kMax})/2$), a representative time ($t_k=(t_{kMin}+t_{kMax})/2$), a size ($\Delta p_k=p_{kMax}-p_{kMin}$), and a maximum value ($Y_{IjkMax}$) and an average value ($Y_{IjkAve}$) of evaluation data of the infrastructure factors are also calculated. In the present embodiment, these feature quantities are also defined as the individual infrastructure factor evaluation data by M2 variables $\{Y_{Ijk}: j=M_1+1, M_1+2, \ldots, M_1+M_2 (=M)\}$.

An infrastructure factor DB construction unit 400 of the condition monitoring/analyzing device 30 stores the individual infrastructure factors acquired by the infrastructure factor estimation unit 300 in an infrastructure factor database.

When an individual infrastructure factor is to be stored in the infrastructure factor database, it is compared with already stored infrastructure factors to determine whether the same infrastructure factor exists. A method for determining the same infrastructure factor is to compare the evaluation data such as positions ($p_k$), speeds ($v_k$), and sizes ($\Delta p_k$) of the infrastructure factors.

As a result of the comparison determination, when the same infrastructure factor exists in the infrastructure factor database, the acquired individual infrastructure factor evaluation data is added to the time range $[t_{kMin}, t_{kMax}]$ of the evaluation data of the same infrastructure factor ($Y_{Ijk}$(p, t)), and when no same infrastructure factor exists, the acquired individual infrastructure factor is registered as a new infrastructure factor.

Further, when an infrastructure factor stored in the infrastructure factor database is not detected by the infrastructure factor estimation unit 300, it is determined that the infrastructure factor is improved by maintenance or removal, and the value of the time range $[t_{kMin}, t_{kMax}]$ is set to zero for the infrastructure factor evaluation data ($Y_{Ijk}$(p, t)) of the removed infrastructure factor in the infrastructure factor database.

An infrastructure factor analysis unit 500 of the condition monitoring/analyzing device 30 monitors the individual infrastructure factor evaluation data stored in the infrastructure factor database, so as to analyze the infrastructure factors.

When a new infrastructure factor is detected by monitoring the infrastructure factor, information (location, scale, etc.) on the infrastructure factor is presented to the output device 50. This makes it possible to know an influential infrastructure factor afterwards. Further, by specifying a range of the new infrastructure factor, the infrastructure factor can be investigated efficiently. When information on the infrastructure factor at the site (presence/absence, type, name, actual measurement data, etc.) can be collected from the investigation result, the investigation result is added to the infrastructure factor database from the input device 40. The investigation of the infrastructure factor is implemented by a system that stores external infrastructure information, an investigator, etc., and investigation information thereof is input/output online and offline.

When the individual infrastructure factor evaluation data ($Y_{Ijk}$(p, t)) stored in the infrastructure factor database increases with time change, it can be determined that the infrastructure factor is deteriorated. Further, when the evaluation data exceeds a deterioration threshold value ($Y_{IjkLim}$), it can be determined that maintenance is necessary. Further, a timing of maintenance can be predicted by calculating individual infrastructure factor evaluation data ($Y_{Ijk}(p, t+\Delta t)$) at a future time ($t+\Delta t$) or a time ($\Delta t$) for the individual infrastructure factor evaluation data ($Y_{Ijk}(p, t+\Delta t)$) in the future to reach the deterioration threshold value. Information on a deterioration state and maintenance of the infrastructure factor is presented to the output device 50, and information on the corresponding results can be added to the infrastructure factor database from the input device 40. The investigation and maintenance of the deterioration state of the infrastructure factor is implemented by an external maintenance system or an infrastructure administrator, and information on the implementation results is input/output online and offline.

When the individual infrastructure factor evaluation data ($Y_{Ijk}(p, t)$) stored in the infrastructure factor database decreases or becomes zero with time change, it can be determined that the infrastructure factor is improved or removed by maintenance. Information on the improvement and removal of the infrastructure factor is presented to the output device 50, and the investigation results can be added to the infrastructure factor database from the input device 40. The investigation of the improvement and removal of the infrastructure factor is implemented by a system that stores external infrastructure information, an investigator, etc., and the investigation information is input/output online and offline.

A car analysis unit 600 of the condition monitoring/analyzing device 30 evaluates a railroad car with respect to the analysis data ($X_{Ai}$, $Y_{Aj}$) measured by the data detection device 20 in consideration of past information stored in the infrastructure factor database.

When a railroad car is to be analyzed, infrastructure factor analysis evaluation data ($Y_{AIj}$) for the analysis data ($X_{Ai}$, $Y_{Aj}$) measured by the data detection device 20 is created from the individual infrastructure factor evaluation data ($Y_{Ijk}$) stored in the infrastructure factor database. That is, a position ($p_A$) and a time ($t_A$) corresponding to the analysis data ($X_{Ai}$, $Y_{Aj}$) are extracted, and the individual infrastructure factor evaluation data ($Y_{Ijk}$) existing at the extracted position ($p_A$) is acquired from the infrastructure factor database. Based on the acquired individual infrastructure factor evaluation data, the evaluation data ($Y_{Ijk}(p_A, t_A)$) for the time ($t_A$) is calculated. By adding the individual infrastructure factor evaluation data acquired at the position and the time for analysis ($\Sigma Y_{Ijk}(p_A, t_A)$), the infrastructure factor analysis evaluation data ($Y_{AIj}$) can be calculated with respect to the analysis data. The calculated infrastructure factor analysis evaluation data for ($Y_{AIj}$) is stored in the infrastructure factor database and is displayed on the output device 50.

Car factor analysis evaluation data ($Y_{Aj}-Y_{AIj}$) is calculated based on the analysis data ($Y_{Aj}$) and the infrastructure factor analysis evaluation data ($Y_{AIj}$) stored in the infrastructure factor database. By using the car factor analysis evaluation data, it is possible to analyze the car condition in consideration of the influence of the car factor only. The analysis result is presented to the output device 50, and the evaluation result for the analysis can be added from the input device 40 to the infrastructure factor database and can be corrected by the input device 40.

When the railroad car is to be analyzed, based on a ratio of the analysis data ($Y_{Aj}$) to the infrastructure factor analysis evaluation data ($Y_{AIj}$) stored in the infrastructure factor database, a degree of influence of the infrastructure factor on the analysis data ($|Y_{AIj}|/|Y_{Aj}|$) is calculated. The calculated degree of influence of the infrastructure factor is stored in the infrastructure factor database and is displayed on the output device 50.

Since the influence of the infrastructure factor on the track on the evaluation data can be known from the degree of influence of the infrastructure factor stored in the infrastructure factor database, the operation management (speed, acceleration, etc.) and the operating conditions of the car instrument (air conditioning, ventilation, etc.) for each traveling position are adjusted. This can improve the comfort and safety of the car and passengers.

Figure 2:
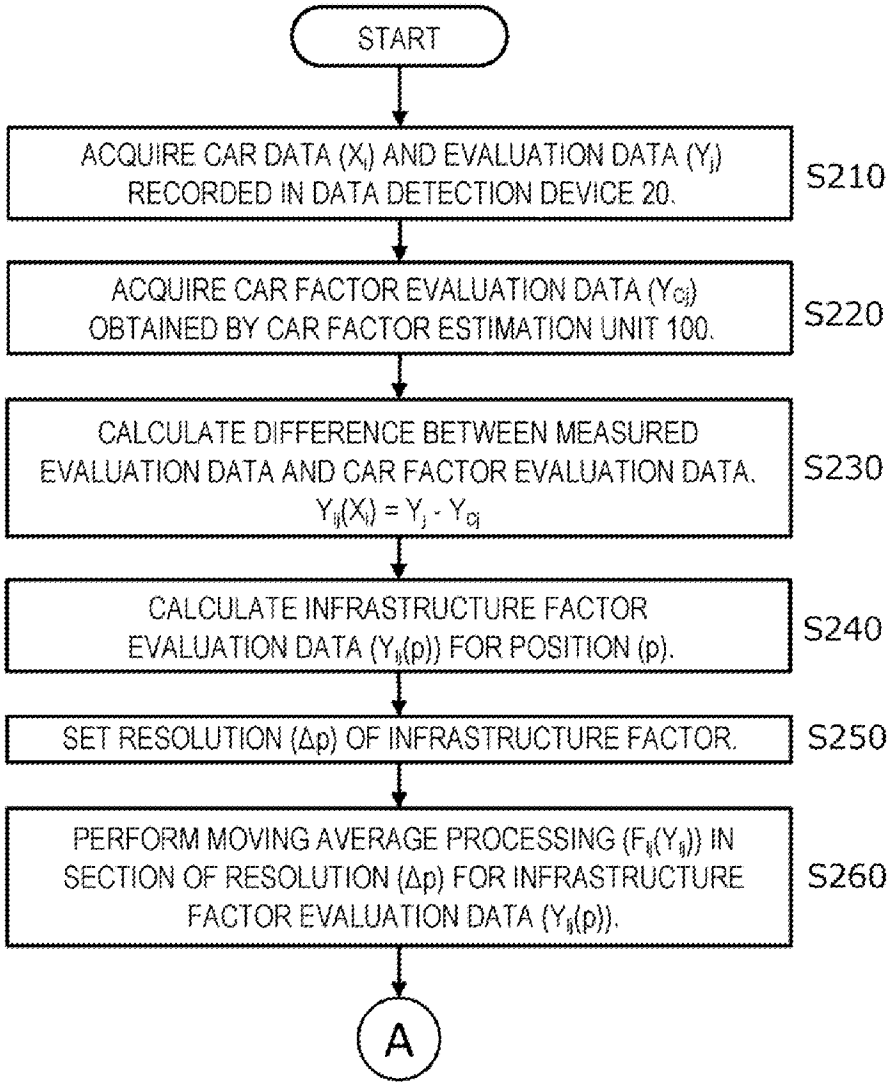
FIG. 2 is a flowchart illustrating a processing procedure of an infrastructure factor extraction unit of the first embodiment.

FIG. 2 is a flowchart illustrating a processing procedure of the infrastructure factor extraction unit 200 of the first embodiment.

In step S210, the car data ($X_i$) measured by the car data detection unit 21 and the evaluation data ($Y_j$) measured by the evaluation data detection unit 22 are acquired.

In step S220, the car factor evaluation data ($Y_{Cj}$) obtained by the car factor estimation unit 100 is acquired.

In step S230, infrastructure factor evaluation data ($Y_{Ij}(X_i)=Y_j-Y_{Cj}$) is obtained based on a difference between the evaluation data ($Y_j$) acquired in step S210 and the car factor evaluation data ($Y_{Cj}$) acquired in step S220.

In step S240, the infrastructure factor evaluation data ($Y_{Ij}(X_i)$) is represented by the infrastructure factor evaluation data ($Y_{Ij}(p)$) with respect to the position (p). The position (p) is an element of the car data ($X_i$) acquired in step S210, and corresponds to a traveling distance from the reference position on the track and the like.

In step S250, a position resolution ($\Delta p$) of the infrastructure factor is set. The resolution is set to a value smaller than possible sizes of the infrastructure factors. Further, the analysis processing is set to be completed within a practical time. Therefore, the sizes and calculation times of the past infrastructure factors stored in the infrastructure factor database can be used.

In step S260, a moving average processing ($F_{Ij}(Y_{Ij})$) is performed on the infrastructure factor evaluation data ($Y_{Ij}(p)$) calculated in step S240 with the position resolution ($\Delta p$) set in step S250.

With the processing of steps S210 to S260, in the infrastructure factor extraction unit 200, the infrastructure factor evaluation data obtained by the difference between the evaluation data and the car factor evaluation data is expanded into infrastructure factor evaluation data with respect to positions on the track, and is averaged in categories considering scales of the infrastructure factors.

Figure 3:
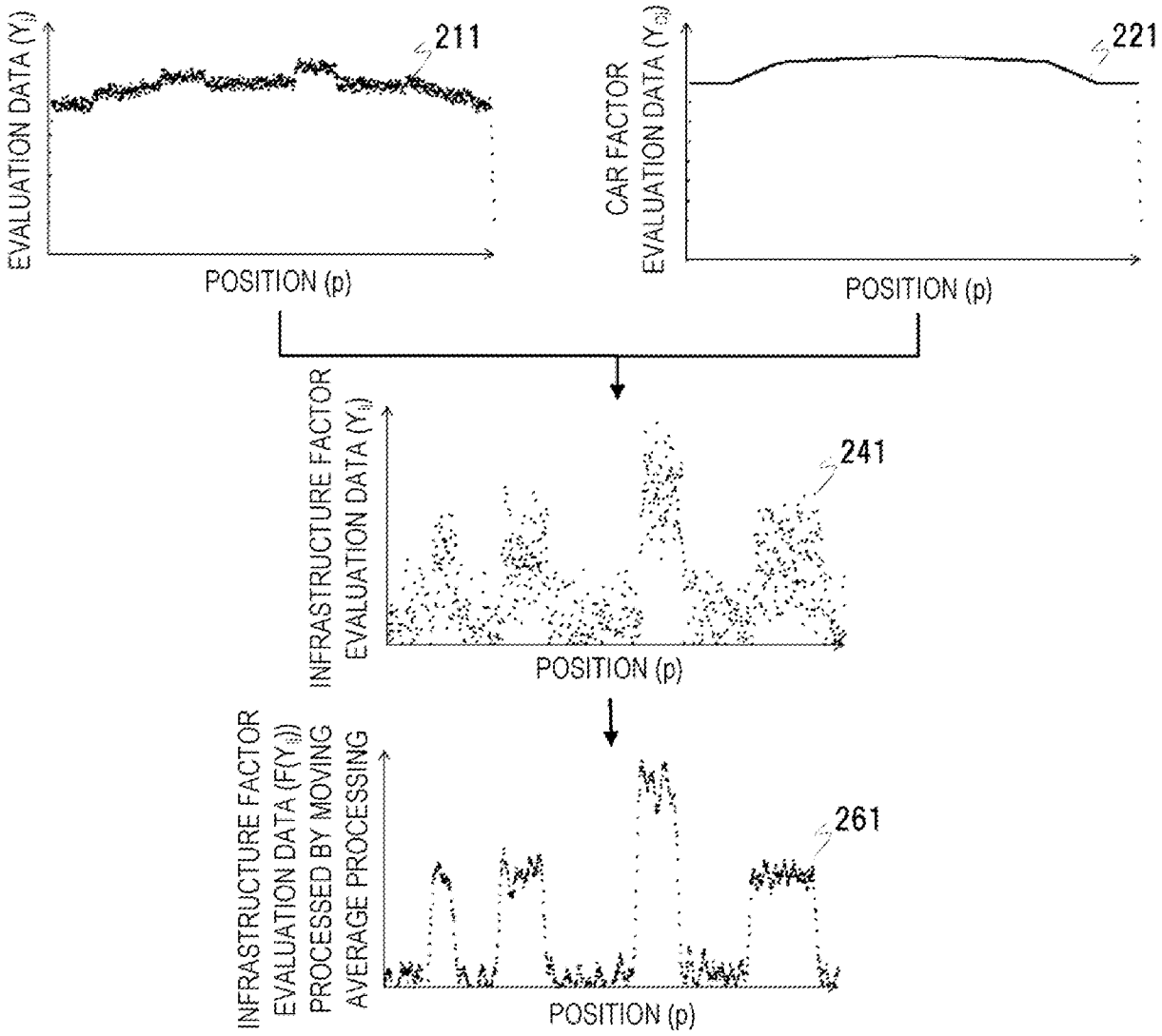
FIG. 3 is a diagram showing an example of data obtained by the processing of steps S210 to S260 of FIG. 2.

FIG. 3 is a diagram showing an example of data obtained by the processing of steps S210 to S260 shown in FIG. 2.

Data 211 is a two-dimensional graph showing a relationship between the car data ($X_i$) and the evaluation data ($Y_j$) obtained in S210. The horizontal axis of the graph represents the position (p) on the track, which is an element of the car data ($X_i$), and the vertical axis represents j-th evaluation data ($Y_j$).

Data 221 is the car factor evaluation data ($Y_{Cj}$) obtained in S220, and represents a two-dimensional graph similar to the data 211.

Data 241 is a two-dimensional graph of the difference between the evaluation data (Y) and the car factor evaluation data ($Y_{Cj}$) obtained in S230 and S240, and represents the infrastructure factor evaluation data ($Y_{Ij}$) with respect to the position (p).

Data 261 is a two-dimensional graph representing infrastructure factor evaluation data ($F(Y_{Ij})$) obtained by the moving average processing of S250 and S260. In this graph, the infrastructure factors exist at positions where the values of the evaluation data are high.

Figure 4:
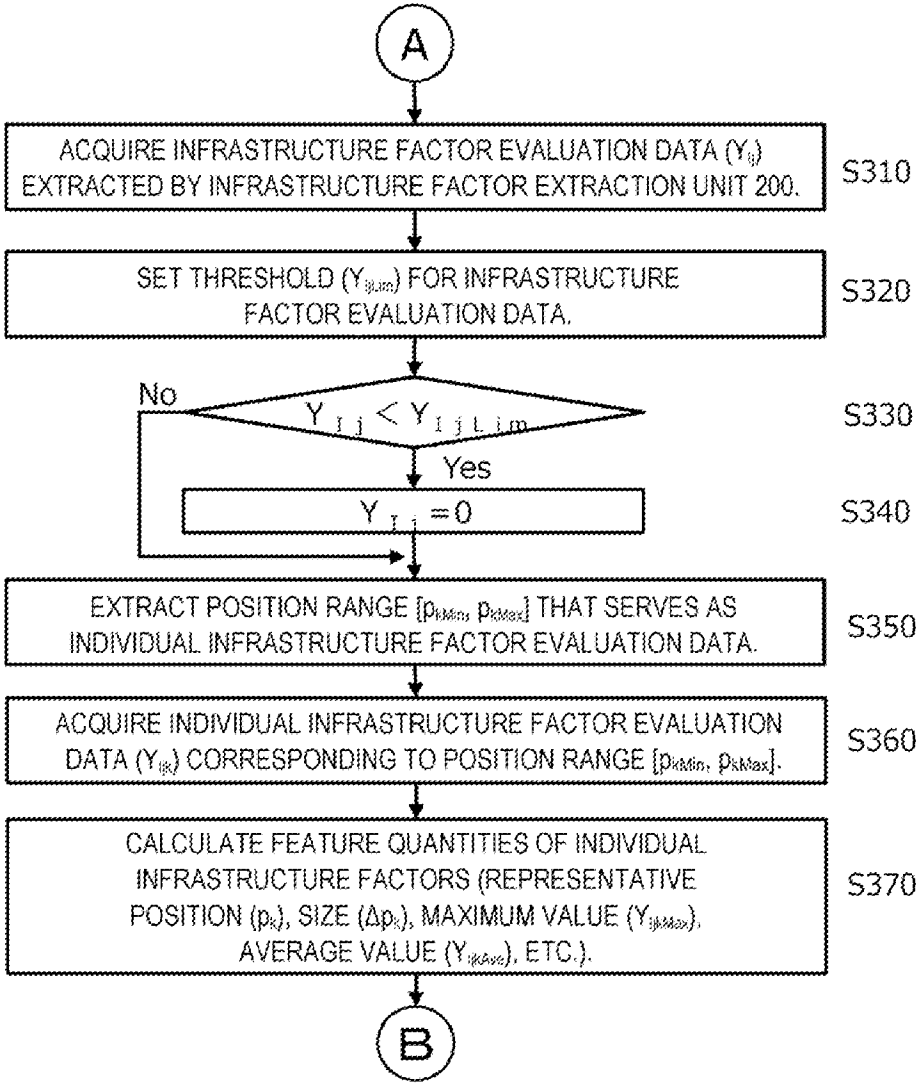
FIG. 4 is a flowchart illustrating a processing procedure of an infrastructure factor estimation unit of the first embodiment.

FIG. 4 shows a flowchart illustrating a processing procedure of the infrastructure factor estimation unit 300 in the first embodiment. Hereinafter, the infrastructure factor evaluation data ($F(Y_{Ij})$) obtained by the moving average processing of S250 and S260 will be treated as "infrastructure factor evaluation data $Y_{Ij}$".

In step S310, the infrastructure factor evaluation data ($Y_{Ij}$) extracted by the processing in S260 of the infrastructure factor extraction unit 200 is acquired.

In step S320, a threshold value ($Y_{IjLim}$) of evaluation data for extracting individual infrastructure factors is input.

In step S330, it is determined whether the infrastructure factor evaluation data ($Y_{Ij}$) is less than the threshold value ($Y_{IjLim}$). If the evaluation data is less than the threshold value, the processing proceeds to step S340, and if not, the processing proceeds to step S350.

In step S340, the infrastructure factor evaluation data ($Y_{Ij}$) that is less than the threshold value is set to zero. This processing allows individual infrastructure factors to be separated from the infrastructure factor evaluation data.

In step S350, a position range $[p_{kMin}, p_{kMax}]$ exceeding zero is extracted from the evaluation data obtained in step S340. The evaluation data of this position range becomes the individual infrastructure factor evaluation data.

In step S360, the evaluation data of the position range $[p_{kMin}, p_{kMax}]$ acquired in step S350 is extracted from the evaluation data obtained in step S340 and is set as the individual infrastructure factor evaluation data ($Y_{Ijk}$).

In step S370, feature quantities of the individual infrastructure factors are calculated. The feature quantities include the representative positions ($p_k=(p_{kMin}+p_{kMax})/2$), the sizes ($\Delta p_k=p_{kMax}-p_{kMin}$), and the maximum values ($Y_{IjkMax}$) and the average values ($Y_{IjkAve}$) of evaluation data. These feature quantities are added as elements of the individual infrastructure factor evaluation data ($Y_{Ijk}$).

With the processing of steps S310 to S370, in the infrastructure factor estimation unit 300, the individual infrastructure factor evaluation data separated by the threshold value input from the input device is acquired, the feature quantities including the representative positions, the sizes, the maximum values, and the average values of the individual infrastructure factor evaluation data is calculated, and the feature quantities are added as elements of the individual infrastructure factor evaluation data.

Figure 5:
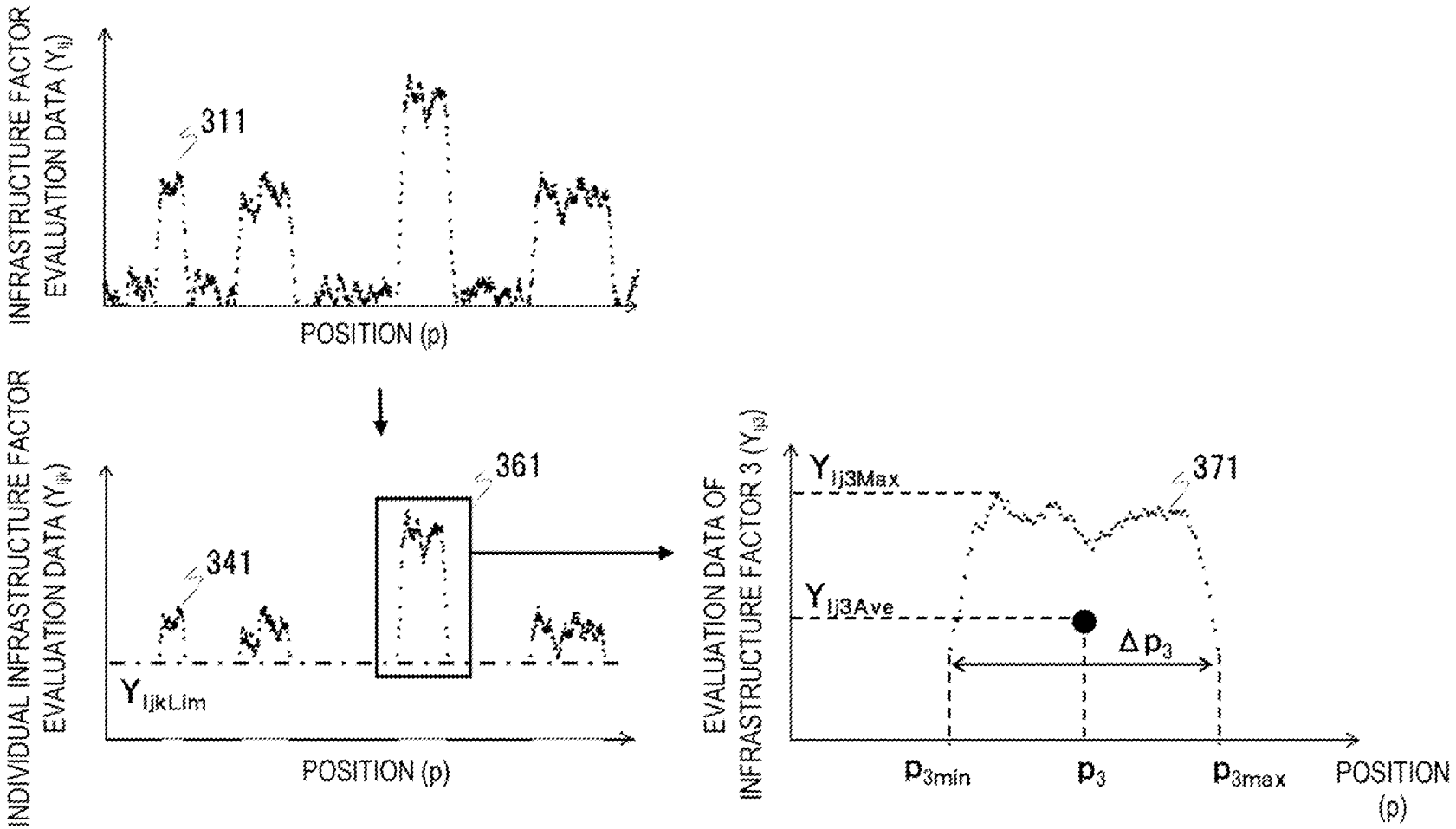
FIG. 5 is a diagram showing an example of data obtained by the processing of steps S310 to S370 of FIG. 4.

FIG. 5 is a diagram showing an example of data obtained by the processing of steps S310 to S370 of FIG. 4.

Data 311 is a two-dimensional graph of the infrastructure factor evaluation data obtained by the processing in S260 of the infrastructure factor extraction unit 200. In the graph, the horizontal axis shows the position (p) of the infrastructure factor and the vertical axis shows the infrastructure factor evaluation data.

Data 341 is a two-dimensional graph of the evaluation data obtained in steps S310 to S340. From this graph, it can be seen that four individual infrastructure factors exist. Data 361 shows the evaluation data of a third infrastructure factor among the four infrastructure factors.

Data 371 shows evaluation data ($Y_{Ij3}$) of the third infrastructure factor obtained by steps S350 to S370 and feature quantities thereof. The feature quantities include the representative position ($p_k=(p_{kMin}+p_{kMax})/2$), the size ($\Delta p_k=p_{kMax}-p_{kMin}$), and the maximum value ($Y_{IjkMax}$) and the average value ($Y_{IjkAve}$) of evaluation data of the infrastructure factor.

Figure 6:
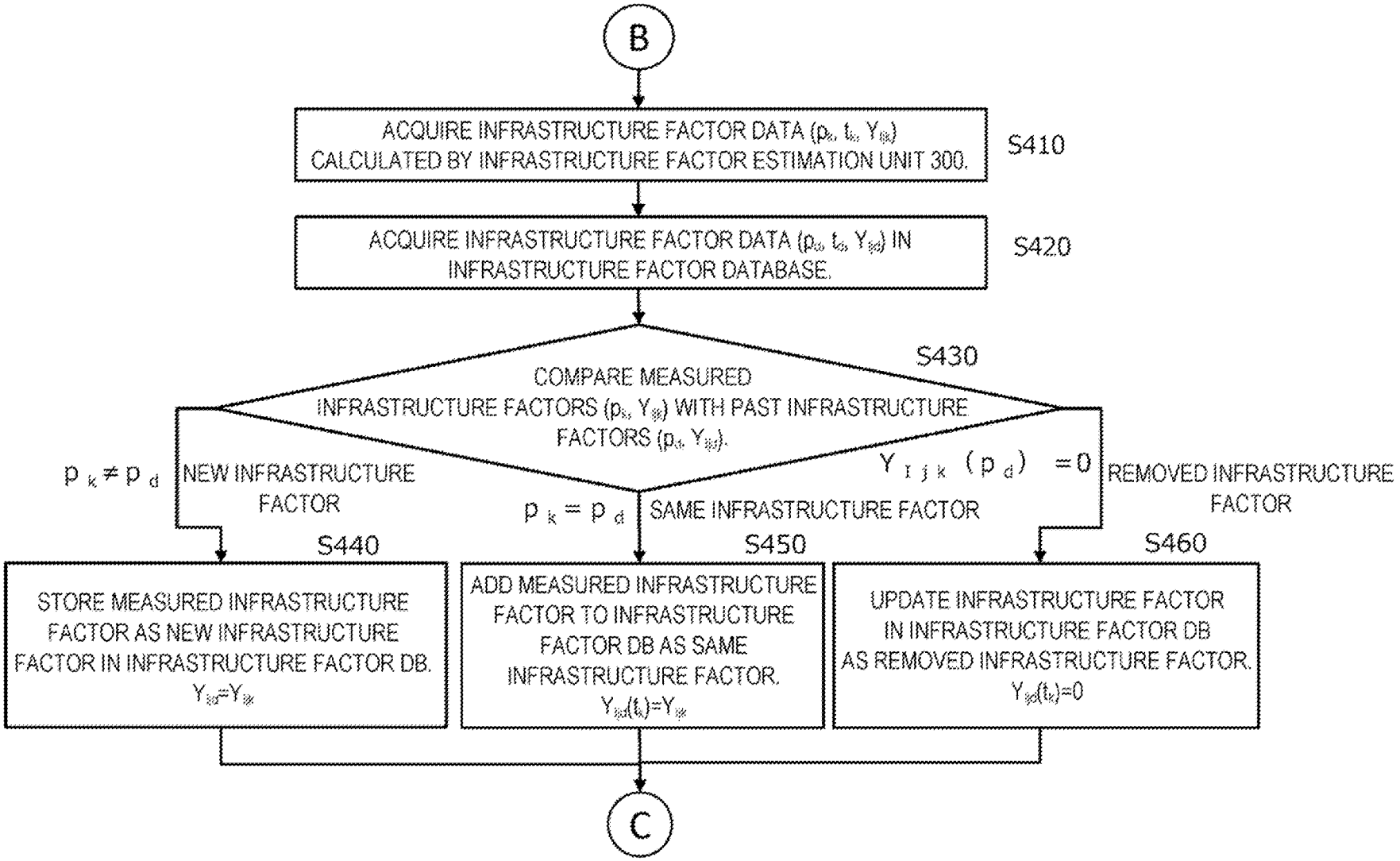
FIG. 6 is a flowchart illustrating a processing procedure of an infrastructure factor DB construction unit of the first embodiment.

FIG. 6 shows a flowchart illustrating a processing procedure of the infrastructure factor DB construction unit in the first embodiment.

In step S410, data of an individual infrastructure factor calculated by the infrastructure factor estimation unit 300 is acquired. The data to be acquired includes the position ($p_k$), the time ($t_k$), and the evaluation data ($Y_{Ijk}$). Further, if multiple infrastructure factors exist, the following steps are repeated in order.

In step S420, data of infrastructure factors stored in the infrastructure factor database is acquired. The data to be acquired is positions ($p_d$), times ($t_d$), and evaluation data ($Y_{Ijd}$), as in step S410.

In step S430, the position ($p_k$) of the infrastructure factor acquired in step S410 and the position ($p_d$) of the infrastructure factor acquired in step S420 are compared with each other. If the positions of the infrastructure factors match with each other, the infrastructure factor is determined as the same infrastructure factor ($p_k=p_d$), and if not, the infrastructure factor is determined as a new infrastructure factor ($p_k\neq p_d$). Further, when an infrastructure factor at the same position as the infrastructure factor existing in the infrastructure factor database cannot be acquired in step S410, it is determined that the infrastructure factor is a removed infrastructure factor ($Y_{Ijk}(p_d)=0$).

In step S440, the infrastructure factor acquired in step S410 is added to the infrastructure factor database as a new infrastructure factor.

In step S450, the infrastructure factor acquired in step S410 is added to the same infrastructure factor stored in the infrastructure factor database as the same infrastructure factor.

In step S460, the evaluation data corresponding to the time ($t_k$) of the infrastructure factor acquired in step S410 is set to zero for the removed infrastructure factor in the infrastructure factor database.

With the processing of steps S410 to S460, in the infrastructure factor DB construction unit 400, by comparing the individual infrastructure factor evaluation data acquired by the infrastructure factor estimation unit with the individual infrastructure factor evaluation data stored in the infrastructure factor database, new infrastructure factor evaluation data that does not exist in the infrastructure factor database is added to the infrastructure factor database, evaluation data of an infrastructure factor the same as an infrastructure factor existing in the infrastructure factor database is added as the evaluation data of the infrastructure factor existing in the infrastructure factor database, and removed infrastructure factor evaluation data that exists in the infrastructure factor database but is not acquired by the infrastructure factor estimation unit is set to zero.

Figure 7:
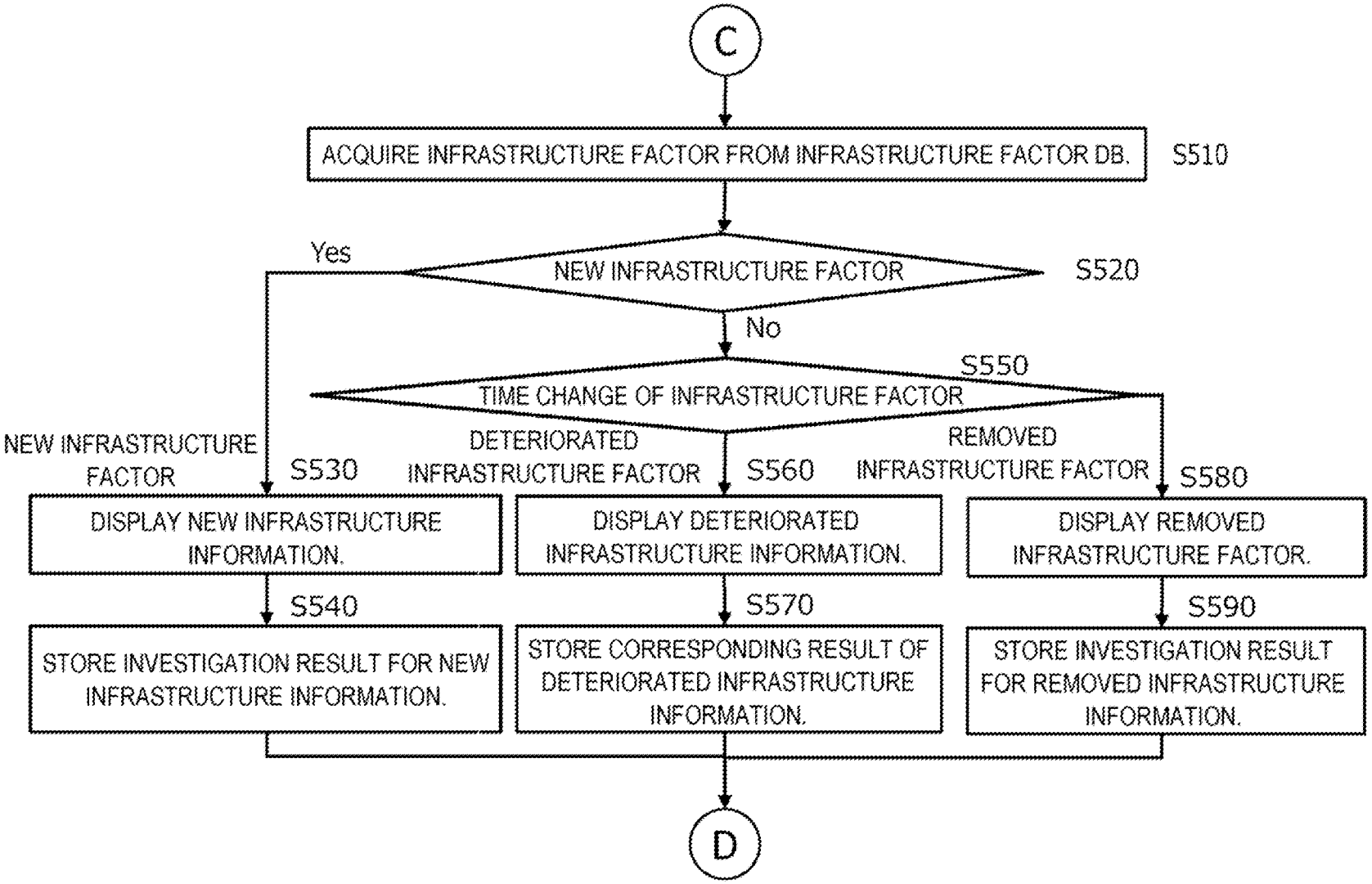
FIG. 7 is a flowchart illustrating a processing procedure of an infrastructure factor analysis unit of the first embodiment.

FIG. 7 is a flowchart illustrating a processing procedure of the infrastructure factor analysis unit 500.

In step S510, all the data of the infrastructure factors stored in the infrastructure factor database is acquired.

In step S520, it is determined whether the infrastructure factor acquired in step S510 is a new infrastructure factor. If the infrastructure factor is a new infrastructure factor, the processing proceeds to step S530, and if not, the processing proceeds to step S550.

In step S530, information (position, size, evaluation data, etc.) on the new infrastructure factor acquired in step S510 is displayed on the output device 50. With this processing, the infrastructure factors subject to the problem to be solved are extracted and the range of the infrastructure factors to be investigated is specified.

In step S540, an investigation result of the new infrastructure factor presented in step S530 is input from the input device 40, and the information on the infrastructure factors in the infrastructure factor database is added or corrected.

In step S550, a time change of the infrastructure factor evaluation data acquired in step S510 is calculated. If the evaluation data increases over time, the infrastructure factor is regarded as a deterioration infrastructure factor, and the processing proceeds to step S560, and if the evaluation data decreases, the infrastructure factor is regarded as a removed infrastructure factor, and the processing proceeds to step S580.

In step S560, the information on the deterioration infrastructure factor (position, size, evaluation data, deterioration information, maintenance information, etc.) acquired in step S510 is displayed on the output device 50. This process predicts the deterioration of the infrastructure factors and presents the timing of maintenance.

In step S570, a corresponding result for the information on the deteriorated infrastructure factor presented in step S560 is input from the input device 40, and the information on the deteriorated infrastructure factors in the infrastructure factor database is added or corrected.

In step S580, the information (position, time, size, evaluation data, etc.) on the removed infrastructure factor acquired in step S510 is displayed on the output device 50. With this processing, infrastructure factors whose infrastructure environment is changed are extracted, and the range of the infrastructure factors to be investigated is specified.

In step S590, an investigation result for the information on the removed infrastructure factor presented in step S580 is input from the input device 40, and the information on the removed infrastructure factors in the infrastructure factor database is added or corrected.

With the processing of steps S510 to S590, in the infrastructure factor analysis unit 500, the individual infrastructure factor evaluation data stored in the infrastructure factor database is analyzed to determine new infrastructure factors, deteriorated infrastructure factors, and removed infrastructure factors, so that information on the new infrastructure factors including locations and scales is output to the output device, and an investigation result of the new infrastructure factors including presence/absence, types, names, and actual measurement data is input from the input device and is registered in the infrastructure factor database; information on the deteriorated infrastructure factors including deterioration state and maintenance diagnosis is output to the output device, and an investigation result for the deteriorated infrastructure factors is input from the input device and is registered in the infrastructure factor database; and information on the removed infrastructure factors including infrastructure environment and maintenance is output to the output device, and an investigation result of the removed infrastructure factors is input from the input device and is registered in the infrastructure factor database.

Figure 8:
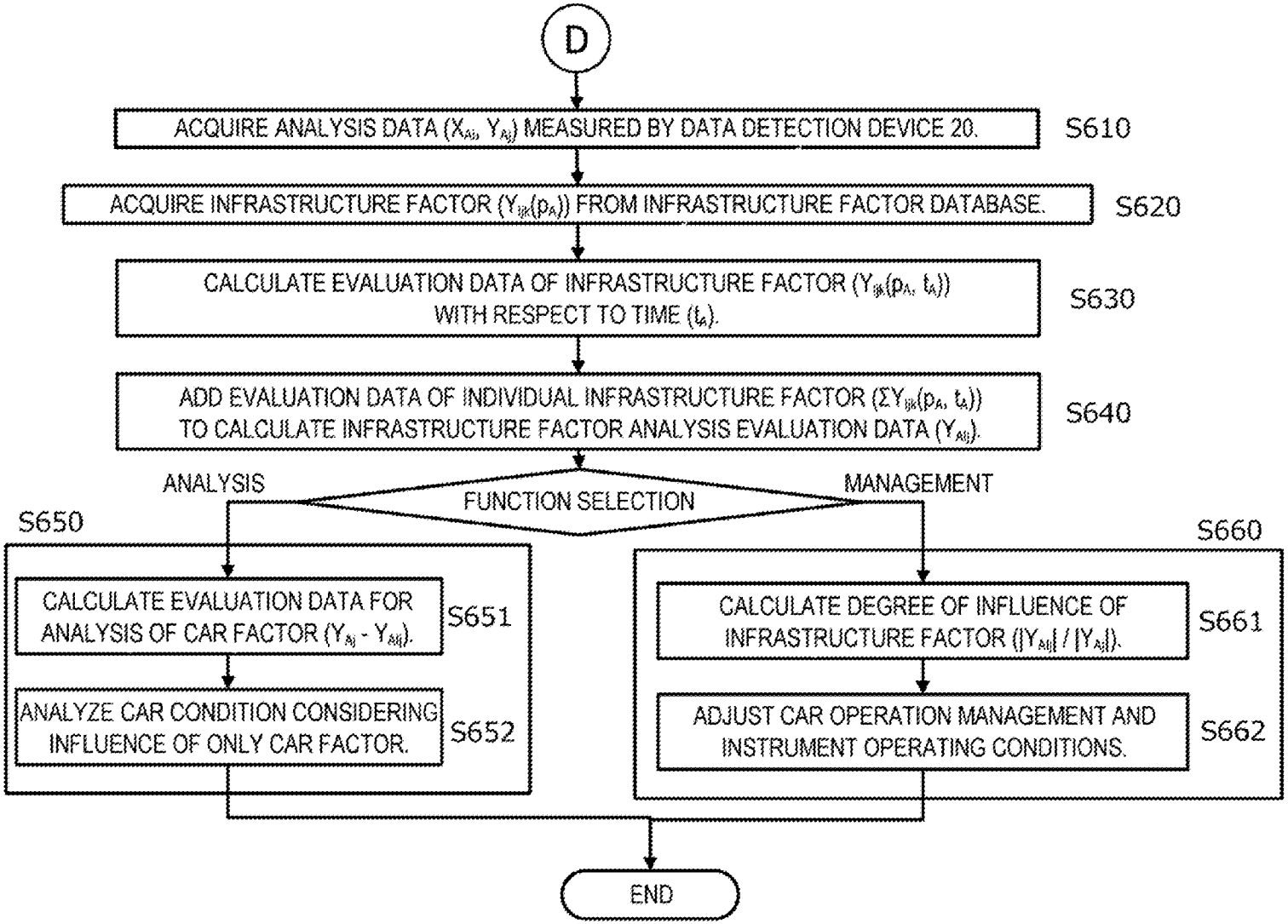
FIG. 8 is a flowchart illustrating a processing procedure of a car analysis unit of the first embodiment.

FIG. 8 shows a flowchart illustrating a processing procedure of the car analysis unit 600 in the first embodiment.

In step S610, the data detection device 20 acquires analysis data ($X_{Ai}$,$Y_{Aj}$) for car analysis.

In step S620, all the individual infrastructure factor evaluation data ($Y_{Ijk}(p_A)$) existing at the position ($p_A$) of the analysis data acquired in step S610 is acquired from the infrastructure factor database.

In step S630, the individual infrastructure factor evaluation data ($Y_{Ijk}(p_A, t_A)$) at the time ($t_A$) of the analysis data is calculated from the individual infrastructure factor evaluation data acquired in step S620.

In step S640, by adding all the individual infrastructure factor evaluation data calculated in step S630 ($\Sigma Y_{Ijk}(p_A, t_A)$) the infrastructure factor analysis evaluation data ($Y_{AIj}$) is calculated. Car analysis (step S650) and management (step S660) are performed using the infrastructure factor analysis evaluation data ($Y_{AIj}$).

In step S651, in the car analysis processing, car factor analysis evaluation data ($Y_{Aj}-Y_{AIj}$) is calculated based on the analysis data ($Y_{Aj}$) acquired in step S610 and the infrastructure factor analysis evaluation data ($Y_{AIj}$) calculated in step S640. With this processing, the evaluation data that affects the car factor only excluding the infrastructure factors can be obtained.

In step S652, the car condition is analyzed and deterioration and maintenance are evaluated using the evaluation data for analysis of the car factor calculated in step S651.

In step S661, in the car management processing, the degree of influence of the infrastructure factors on analysis data ($|Y_{AIj}|/|Y_{Aj}|$) is calculated based on the analysis data ($Y_{Aj}$) acquired in step S610 and the infrastructure factor analysis evaluation data ($Y_{AIj}$) calculated in step S640. This processing reveals where the infrastructure factors have a large influence.

In step S662, the degree of influence of the infrastructure factors calculated in step S661 is used to adjust the operation management of the car (speed, acceleration, etc.) and the operating conditions of the car instruments (air conditioning, ventilation, etc.) according to the conditions of the track. This improves the comfort and safety of the car and the passengers.

With the processing of steps S610 to S660, in the car analysis unit 600, the infrastructure factor analysis evaluation data is calculated based on the past infrastructure factor evaluation data stored in the infrastructure factor database, the car condition is analyzed based on the analysis data measured by the data detection device and the infrastructure factor analysis evaluation data in consideration of the influence of the car factor only, and the degree of influence of the infrastructure factors on the analysis data is calculated based on the analysis data and the infrastructure factor analysis evaluation data so as to adjust the operation management for each traveling position including the speed the and acceleration and the operating conditions of the car instruments including the air conditioning and the ventilation.

The invention is not limited to the above-mentioned embodiment, and includes various modifications. For example, the above-mentioned embodiment has been described in detail for easy understanding of the invention, and is not necessarily limited to those having all the described configurations. Further, a part of the configuration of the embodiment may be added, deleted, or replaced with another configuration.

What is claimed is:

1. A railroad car condition monitoring/analyzing device configured to be connected to a data detection device that measures car data and evaluation data with a sensor mounted on a car, and an input device and an output device that input and output data, the railroad car condition monitoring/analyzing device comprising:

a car factor estimation unit configured to estimate car factor evaluation data from the car data and the evaluation data;

an infrastructure factor extraction unit configured to extract infrastructure factor evaluation data from the car data, the evaluation data, and the car factor evaluation data;

an infrastructure factor estimation unit configured to estimate individual infrastructure factor evaluation data from the infrastructure factor evaluation data;

an infrastructure factor DB construction unit configured to store the individual infrastructure factor evaluation data in an infrastructure factor database;

an infrastructure factor analysis unit configured to monitor the individual infrastructure factor evaluation data stored in the infrastructure factor database so as to analyze infrastructure factors; and a car analysis unit configured to analyze a car condition in consideration of analysis information on the infrastructure factors, wherein the infrastructure factor analysis unit is configured to analyze the individual infrastructure factor evaluation data stored in the infrastructure factor database to determine new infrastructure factors, deteriorated infrastructure factors, and removed infrastructure factors, thereby outputting information on the new infrastructure factors including locations and scales to the output device, and receiving an investigation result of the new infrastructure factors including presence/absence, types, names, and actual measurement data from the input device so as to register the investigation result in the infrastructure factor database; outputting information on the deteriorated infrastructure factors including deterioration states and maintenance diagnosis to the output device, and receiving an investigation result of the deteriorated infrastructure factors from the input device so as to register the investigation result in the infrastructure factor database; and outputting information on the removed infrastructure factors including infrastructure environment and maintenance to the output device, and receiving an investigation result of the removed infrastructure factors from the input device so as to register the investigation result in the infrastructure factor database.

2. The railroad car condition monitoring/analyzing device according to claim 1, wherein the infrastructure factor extraction unit is configured to expand the infrastructure factor evaluation data obtained by determining a difference between the evaluation data and the car factor evaluation data into infrastructure factor evaluation data with respect to positions on a track, and perform averaging processing in categories considering scales of infrastructure factors.

3. A railroad car condition monitoring/analyzing system comprising:

the railroad car condition monitoring/analyzing device according to claim 2;

the data detection device;

the input device; and the output device.

4. The railroad car condition monitoring/analyzing device according to claim 1, wherein the infrastructure factor estimation unit is configured to acquire the individual infrastructure factor evaluation data separated by a threshold value input from the input device, calculate feature quantities including a representative position, a size, a maximum value, and an average value of the individual infrastructure factor evaluation data, and add the feature quantities as elements of the individual infrastructure factor evaluation data.

5. A railroad car condition monitoring/analyzing system comprising:

the railroad car condition monitoring/analyzing device according to claim 4;

the data detection device;

the input device; and the output device.

6. The railroad car condition monitoring/analyzing device according to claim 1, wherein the infrastructure factor DB construction unit is configured to compare the individual infrastructure factor evaluation data acquired by the infrastructure factor estimation unit with individual infrastructure factor evaluation data stored in the infrastructure factor database, so as to add new infrastructure factor evaluation data that does not exist in the infrastructure factor database to the infrastructure factor database, add infrastructure factor evaluation data of infrastructure factors the same as infrastructure factors existing in the infrastructure factor database as the infrastructure factor evaluation data existing in the infrastructure factor database, and set removed infrastructure factor evaluation data that exists in the infrastructure factor database but is not acquired by the infrastructure factor estimation unit to zero.

7. A railroad car condition monitoring/analyzing system comprising:

the railroad car condition monitoring/analyzing device according to claim 6;

the data detection device;

the input device; and the output device.

8. A railroad car condition monitoring/analyzing device configured to be connected to a data detection device that measures car data and evaluation data with a sensor mounted on a car, and an input device and an output device that input and output data, the railroad car condition monitoring/analyzing device comprising:

a car factor estimation unit configured to estimate car factor evaluation data from the car data and the evaluation data;

an infrastructure factor extraction unit configured to extract infrastructure factor evaluation data from the car data, the evaluation data, and the car factor evaluation data;

an infrastructure factor estimation unit configured to estimate individual infrastructure factor evaluation data from the infrastructure factor evaluation data;

an infrastructure factor DB construction unit configured to store the individual infrastructure factor evaluation data in an infrastructure factor database;

an infrastructure factor analysis unit configured to monitor the individual infrastructure factor evaluation data stored in the infrastructure factor database so as to analyze infrastructure factors; and a car analysis unit configured to analyze a car condition in consideration of analysis information on the infrastructure factors, wherein the car analysis unit is configured to calculate infrastructure factor analysis evaluation data based on past infrastructure factor evaluation data stored in the infrastructure factor database, analyze a car condition based on analysis data measured by the data detection device and the infrastructure factor analysis evaluation data in consideration of an influence of a car factor only, and calculate a degree of influence of the infrastructure factors on the analysis data based on the analysis data and the infrastructure factor analysis evaluation data, so as to adjust an operation management for each traveling position including a speed and an acceleration and operating conditions of car instruments including air conditioning and ventilation.

9. A railroad car condition monitoring/analyzing system comprising:

the railroad car condition monitoring/analyzing device according to claim 8;

the data detection device;

the input device; and the output device.

10. A railroad car condition monitoring/analyzing system comprising:

the railroad car condition monitoring/analyzing device according to claim 1;

the data detection device;

the input device; and the output device.

11. A railroad car condition monitoring/analyzing method using the railroad car condition monitoring/analyzing device according to claim 1, comprising:

a car factor estimation step of estimating the car factor evaluation data from the car data and the evaluation data;

an infrastructure factor extraction step of extracting the infrastructure factor evaluation data from the car data, the evaluation data, and the car factor evaluation data;

an infrastructure factor estimation step of estimating the individual infrastructure factor evaluation data from the infrastructure factor evaluation data;

an infrastructure factor DB construction step of storing the individual infrastructure factor evaluation data in the infrastructure factor database;

an infrastructure factor analysis step of monitoring the individual infrastructure factor evaluation data stored in the infrastructure factor database so as to analyze infrastructure factors; and a car analysis step of analyzing a car condition in consideration of analysis information on the infrastructure factors.

* * * * *